United States Patent [19]

Ste. Marie

[11] Patent Number: 4,993,671

[45] Date of Patent: Feb. 19, 1991

[54] PAINT BRUSH HOLDER

[76] Inventor: Ray M. Ste. Marie, 16532 Stent Rd., Jamestown, Calif. 95327

[21] Appl. No.: 408,605

[22] Filed: Sep. 18, 1989

[51] Int. Cl.[5] ..... A46B 17/00

[52] U.S. Cl. ..... 248/113; 211/65; 248/213.2

[58] Field of Search ..... 248/110, 111, 113, 213.2; 211/65

[56] References Cited

U.S. PATENT DOCUMENTS

| | | | |
|---|---|---|---|
| 1,783,119 | 11/1930 | Hacking | 248/113 |
| 1,848,450 | 3/1932 | Williamson . | |
| 1,958,772 | 5/1934 | Stewart | 248/113 |
| 2,325,595 | 8/1943 | Dieke | 248/113 |
| 2,469,864 | 5/1949 | Craft et al. | 248/110 |
| 2,529,257 | 11/1950 | Kerby | 248/110 |
| 2,535,260 | 12/1950 | Braswell | 248/113 X |
| 2,567,326 | 9/1951 | Entsminger | 220/90 |
| 2,674,391 | 4/1954 | Davis | 248/113 X |
| 2,676,730 | 4/1954 | Hedglon | 220/90 |
| 2,715,478 | 8/1955 | Andersen | 248/110 X |
| 2,803,374 | 8/1957 | Cash | 220/90 |
| 3,275,187 | 9/1966 | Lamoureaux | 220/90 |
| 3,695,488 | 10/1972 | Olsson | 222/570 |
| 4,125,210 | 11/1978 | Embree | 248/110 X |
| 4,266,686 | 5/1981 | Carter | 211/65 X |
| 4,266,746 | 5/1981 | Klaiber | 248/113 |
| 4,275,818 | 6/1981 | Church | 220/90 |
| 4,377,239 | 3/1983 | Jimae | 211/65 |

*Primary Examiner*—David L. Talbott
*Attorney, Agent, or Firm*—Glenn D. Bellamy

[57] ABSTRACT

A paint brush holder, attachable to a container having an opening with an annular lip, has a brush-supporting bed with inner and outer ends. A brush handle-gripping spring clamp with leaf spring tines for longitudinally engaging a paint brush handle is adjacent the outer end. A snap-lock attachment having first and second downwardly extending arcuate flanges with an arcuate groove defined therebetween is located adjacent the inner end for engaging the annular lip.

9 Claims, 3 Drawing Sheets

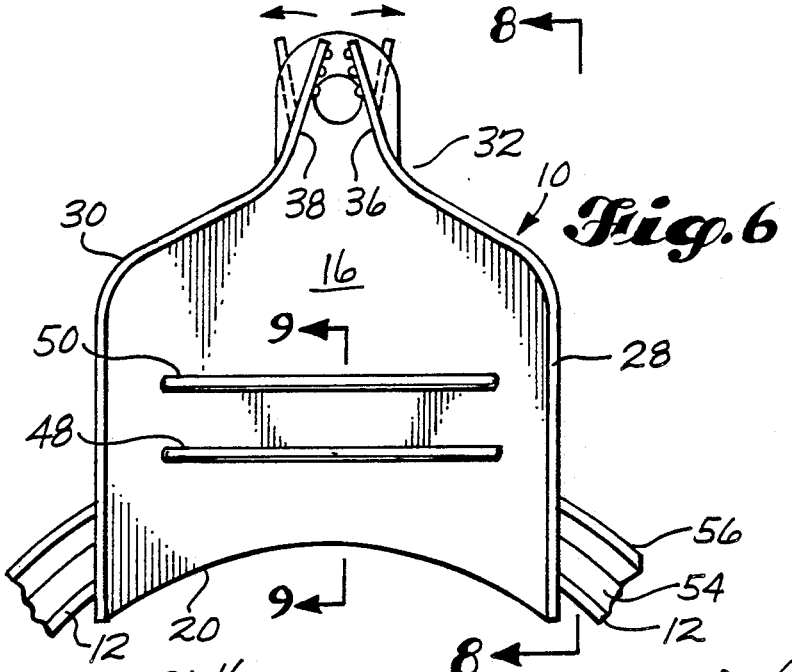
Fig. 6
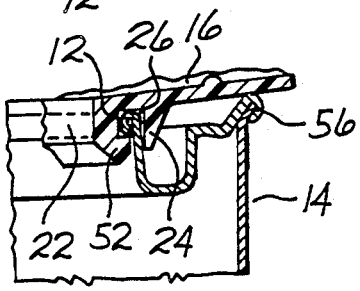
Fig. 10
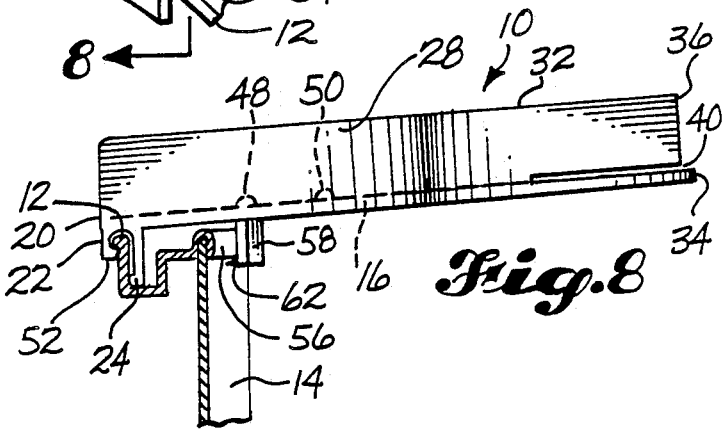
Fig. 8
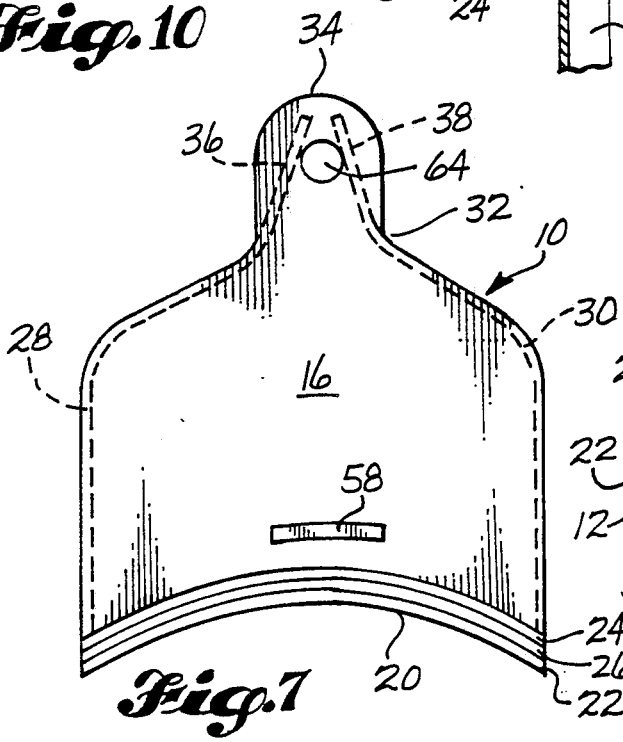
Fig. 7
Fig. 9
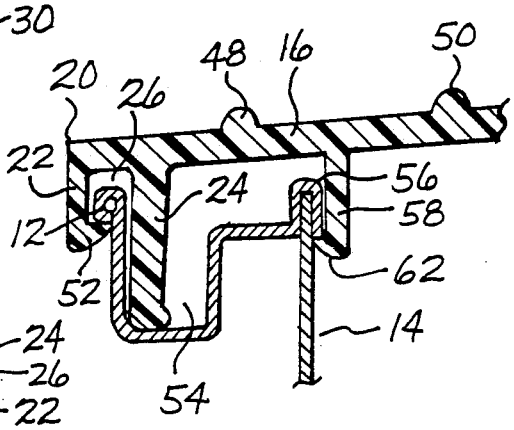

PAINT BRUSH HOLDER

DESCRIPTION

1. Technical Field

This invention relates to a device for holding and wiping paint brushes and, in particular, to such a device which is attachable to the lip of a paint can to positively engage the brush's handle regardless of size or shape and to provide a wiping edge which directs excess paint to drip into the paint can.

2. Background Art

In the operation of applying paint to a surface with a brush, the paint is most commonly used directly from the container in which it was purchased. Typically, this container is a cylindrical can with a top opening and an annular lip around the opening. A lid-receiving lock groove is defined by the annular lip.

Routinely, the bristles of the brush are filled by dipping it directly into the can of paint and then wiping the bristles against the lip of the paint can to remove excess paint which would likely drip from the brush prior to its reaching the surface to be painted. This wiping step often results in paint collecting in the lid-receiving groove around the opening of the can and/or paint running down the exterior of the can.

During the course of the painting operation, it often becomes necessary to temporarily interrupt work and to free the painter's hands by putting the brush down. Most commonly, the brush is set down across the open mouth of the paint can which undesirably results in the handle of the brush becoming coated with paint and excess paint in the bristles dripping over the edge of the can onto the floor.

Prior art devices have been made in an attempt to provide a paint brush holding and wiping tool to eliminate these problems. Craft et al. in U.S. Pat. No. 2,469,864; Cash in U.S. Pat. No. 2,803,374; Lamoureaux in U.S. Pat. No. 3,275,187; and Church in U.S. Pat. No. 4,275,818 each show paint brush holding and wiping devices attachable to a paint can. The prior art devices most commonly rely on the paint brush having a narrowed neck portion at which to engage the brush and thereby prevent it from falling free of the holder device. Others rely on the brush handle having a hanging hole by which the brush is held in place by a pin extending from the holder.

Cash and Church each disclose devices which can laterally grip the paint brush handle with frictional or clamping force. Successful operation of these handle-clamping members depends upon their exerting sufficient squeezing force to overcome the downward/forward slipping of the brush. Exerting the force necessary to free the brush handle from this type of clamp often results in dislodging the device from the can. These devices are also typically relatively expensive to manufacture.

Another common shortcoming among each of the prior art devices is the lack of a mounting means which is both reliable and inexpensive to manufacture. Olsson in U.S. Pat. No. 3,695,488 discloses a flexible pouring spout particularly designed for attachment to the lip of a paint can opening. This device operates on the principle of providing an arcuate groove with a radius of curvature larger than the radius of curvature of the container' lip. The spout is held onto the lip by the spring energy imparted to it by the spout being flexed to fit the lip of the container.

SUMMARY OF THE INVENTION

The present invention provides a paint brush holder, attachable to a container having an opening with an annular lip around the opening, such as a typical paint can. The holder includes a brush-supporting bed with an inner end and an outer end. A brush handle-gripping spring clamp is located adjacent the outer end and includes first and second leaf spring tines for longitudinally engaging a paint brush handle. A snap-lock attachment adjacent the inner end includes first and second downwardly extending arcuate flanges which define an arcuate groove therebetween.

Sidewalls may extend upwardly from side edges of the bed and each one of the tines may be a longitudinal extension of a separate one of the sidewalls. A break may be defined longitudinally between each tine and the bed. The tines may be flexibly moved apart by placing the paint brush handle between them. The spring energy of the tines biases them against the handle to prevent movement of the paint brush toward the inner end.

This construction provides a positive engagement of paint brush handles of various sizes and/or shapes. The handle-gripping portions which extend toward the outer end are able to positively engage the paint brush handle using less force from stored spring energy than prior art devices which utilize upwardly-projecting tabs.

The snap-lock attachment has an arcuate groove which is shaped to receive and engage an arcuate portion of the container's lip so as to support the device on the container. The first flange may include a hook portion positioned to extend below the lip. To attach the holder, the flanges are flexed apart as the lip is inserted into the arcuate groove and then the flanges return to normal position when the lip is fully engaged within the groove. The second flange may be positioned to extend downwardly into the lid-receiving groove. An additional leg member may also downwardly extend from the bed in a position to engage an outer edge of the container.

This construction of a snap-lock attachment allows the paint brush holder to be positioned so as not to unnecessarily produce the available area of the container's opening. Furthermore, the snap-lock attachment provides a positive engagement of the holder to the can which will not allow paint to seep into the lid-receiving groove nor to allow the holder to be displaced from the container when a brush is removed from the handle-gripping spring clamp.

BRIEF DESCRIPTION OF THE DRAWING

Like reference numerals are used to refer to like parts throughout the various figures of the drawing, wherein:

Fig. 6 is a top plan view of the invention positioned on a portion of a paint can;

Fig. 7 is a bottom plan view of the paint brush holder.

Fig. 8 is a side view taken substantially along line 8—8 of FIG. 3;

FIG. 9 is a fragmentary, cross-sectional view taken substantially along line 9—9 of FIG. 3; and FIG. 10 is a fragmentary, cross-sectional view of another embodiment of the snap-lock attachment.

BEST MODE FOR CARRYING OUT THE INVENTION

Figure 1:
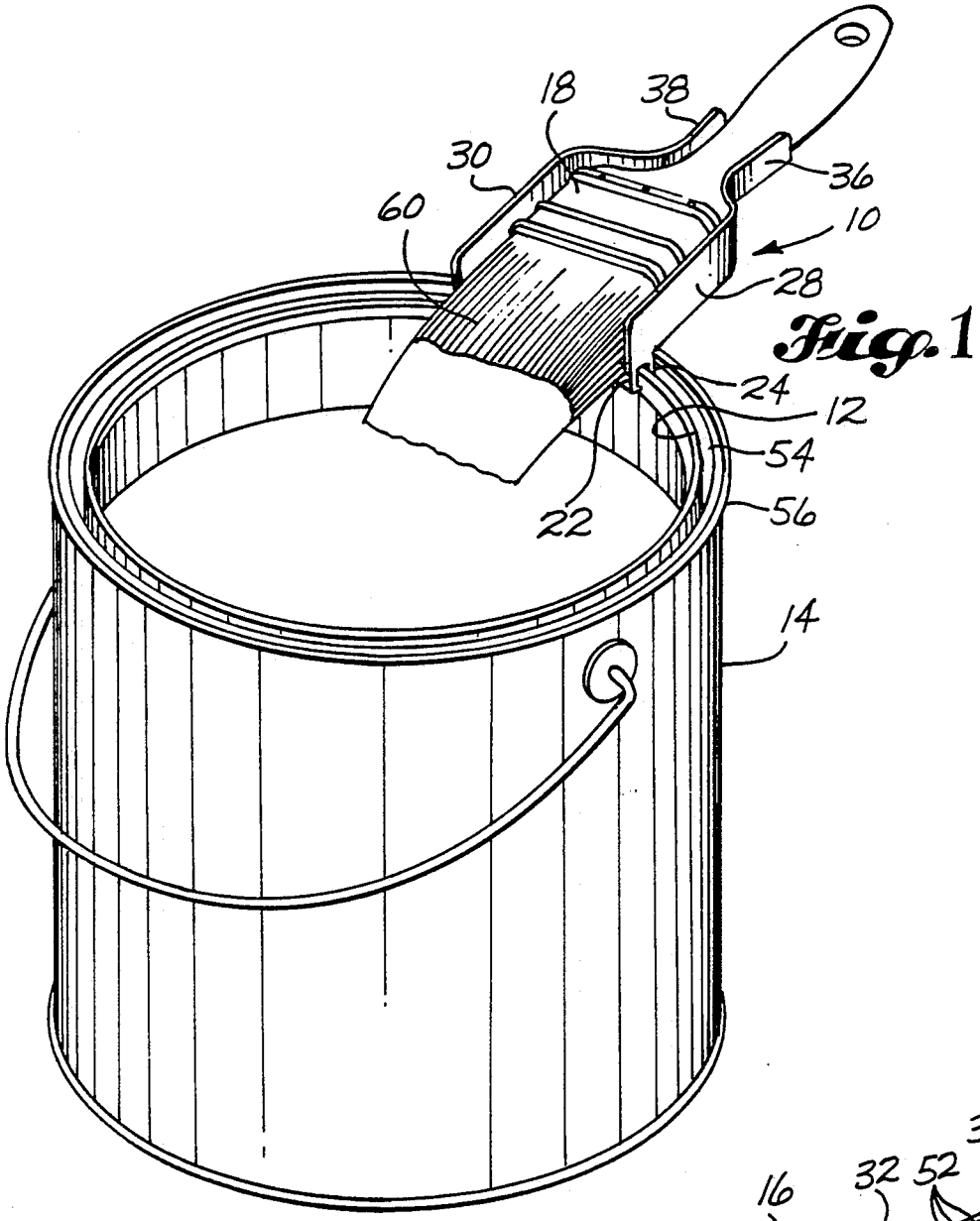
Fig. 1 is a pictorial view of the paint brush holder according to the preferred embodiment of the invention positioned on the rim of a paint can and holding a paint brush thereon.
Figure 2:
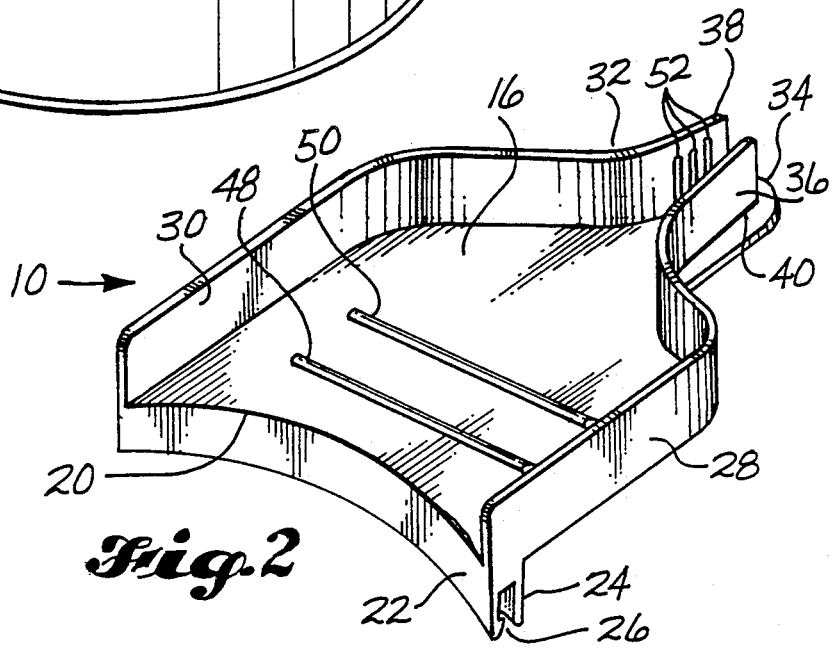
FIG. 2 is a pictorial view of the paint brush holder according to the preferred embodiment of the invention.

Referring to the several figures of the drawing, and first to FIG. 1, therein is shown at 10 a paint brush holder according to the preferred embodiment of the invention. The holder 10 is attached to and supported by an annular lip 12 at the opening of a common paint can 14. Referring now also to FIG. 2, the holder 10 includes a brush-supporting bed 16 upon which a paint brush 18 may be rested. Downwardly extending from a front or inner edge 20 of the bed 16 are first and second arcuate flanges 22, 24. An arcuate groove 26 is defined between the flanges 22, 24. The radius of curvature of the groove 26 and flanges 22, 24 is substantially the same as the radius of curvature of the lip 12 of an ordinary paint can 14. Because most household paint is sold in one-gallon containers, the holder 10 is preferably designed to correspond with and fit a one-gallon paint can. However, the holder 10 could be designed for use with other sized containers, including quarts, pints, and five-gallon pails. The exact construction and function of the attachment flanges 22, 24 and groove 26 will be described in detail below.

Figure 3:
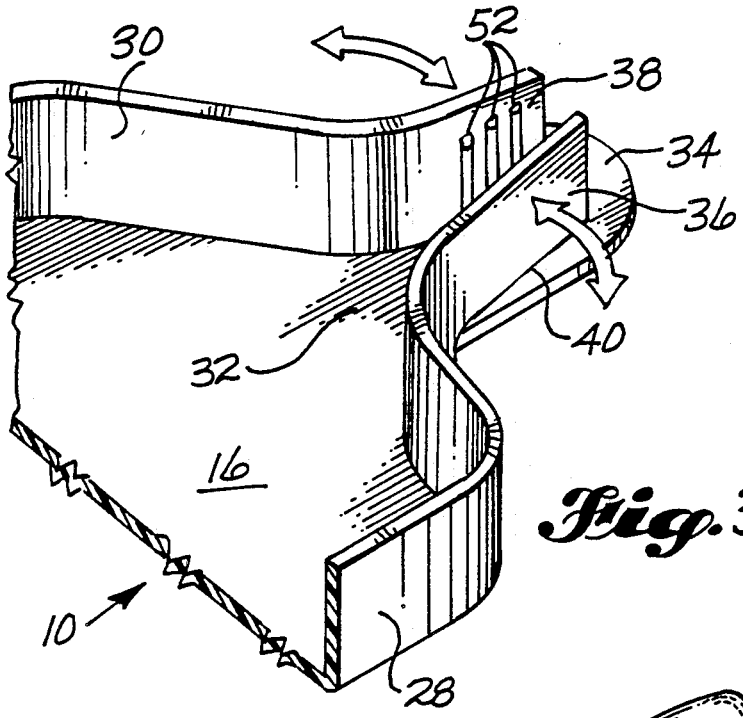
FIG. 3 is an enlarged fragmentary view showing the handle-gripping leaf spring tines.

Extending upwardly from opposite side edges of the bed 16 are sidewalls 28, 30. The sidewalls 28, 30 and bed 16 narrow to form a neck portion 32 near the outward end 34. Extending toward the outward end 34 from each sidewall 28, 30 is a resiliently bendable handle-gripping tine 36, 38. As illustrated in detail in FIG. 3, each tine 36, 38 acts as a leaf spring flexibly movable from its normal position. In preferred form, each leaf spring tine 36, 38 is a longitudinal extension of each sidewall 28, 30 and a narrow gap or break 40 is defined between each tine 36, 38 and the bed 16. This construction allows each tine 36, 38 to be bendable along its length between its point of connection to its respective sidewall 28, 30 and free end.

Figure 4:
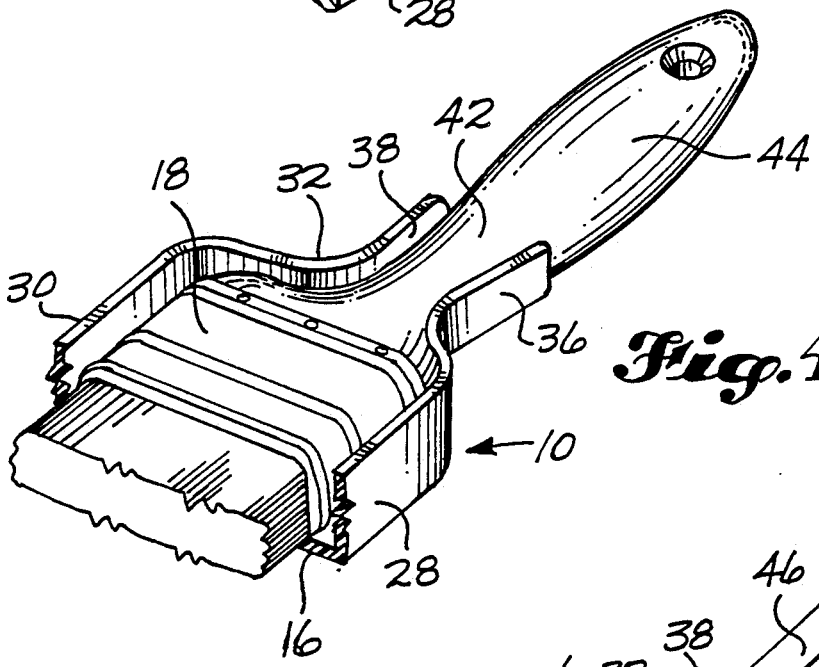
Fig. 4 is an enlarged fragmentary view showing a large paint brush engaged in the handle-gripping spring clamp.

Referring now to FIG. 4, therein is shown the holder 10 with a large-sized paint brush 18 engaged in the handle-gripping spring clamp. Many paint brushes 18 have a handle with a narrowed neck portion 42 and an enlarged grip portion 44. As illustrated in FIGS. 4 and 6, the tines 36, 38 are bendable away from each other as necessary to accommodate such handles.

Figure 5:
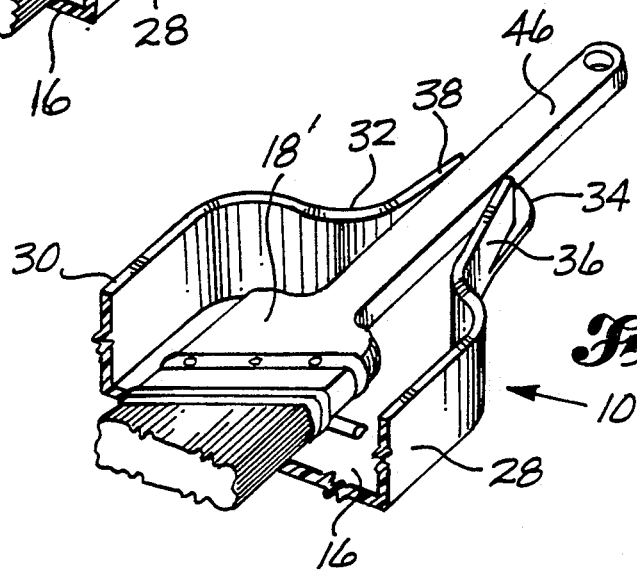
Fig. 5 is an enlarged fragmentary view showing a smaller brush engaged in the handle-gripping spring clamp.

Referring now to FIG. 5, therein is shown the handle-gripping portion of the holder 10 with a smaller trim brush 18′ engaged therein. The illustrated brush 18′ has a narrow, straight handle 46. Because the handle 46 is of the same width along its entire length, there is no narrowed neck portion to be engaged by stationery tines. According to the present invention, the leaf spring tines 36, 38 are biased into contact with the handle 46 placed therebetween and, because of their outward orientation, particularly engage the brush 18′ and handle 46 against movement toward the inner end or front edge 20 of the bed 16. The handle-gripping spring tines 36, 38 create a one-way locking action allowing the handle of the brush 18, 18′ to be easily inserted or removed from between the tines 36, 38 but positively bracing it against movement toward the opening of the paint can 14. The ease of release of the handle as it is lifted from the holder 10 facilitates the holder remaining engaged on the can 14 as the brush 18, 18′ is removed.

Referring especially now to FIGS. 2 and 6, other features may be built into the holder 10 to further enhance the positive gripping of a paint brush 18. A plurality of transverse ridges 48, 50 may be placed on the upper surface of the bed 16 to bare against the downward surface of the brush 18. The ridges 48, 50 also maintain a slight gap between the brush 18 and bed 16 so that any small trace of paint dripped upon the bed 16 will not necessarily come into contact with the downward side of the paint brush 18. Also, friction ridges may be placed on inward surfaces of the spring tines 36, 38 to enhance their gripping contact with the brush handle.

Referring now especially to FIGS. 8 and 9, the preferred snap-lock attachment includes a first flange 22 extending downwardly from the bed 16 along its front edge 20. It is preferred that the front edge 20 be formed with a radius of curvature co-centric with that of the first flange 22. The first flange 22 may also include a hook edge 52 which extends below the lip 12 of the can 14. A second flange 24 extends downwardly from the bed 16 at a position slightly outward from the first flange 22. The first and second flanges 22, 24 are formed at a co-centric radius of curvature to define an arcuate groove 26 therebetween which substantially corresponds with the radius of curvature of the can's lip 12.

A basic form of the above-described snap-lock attachment is shown in FIG. 10. FIGS. 8 and 9 show a preferred embodiment which includes the second flange 24 extending downwardly to the bottom of a lid-receiving groove 54 which is defined between the can's lip 12 and outer rim 56. In this manner, the holder 10 is cantilevered outwardly beyond the rim 56 of the can 14 by engagement of the hook edge 52 under the lip 12 and resting of the second flange 24 in the lid-receiving groove 54. As shown in FIG. 10, the holder 10 may be sufficiently supported without the further extension of the second flange 24, but may require that the bed 16 rest against the rim 56 of the can 14 for additional support.

In operation, the flanges 22, 24 are sprung apart as the lip 12 is inserted therebetween. In this manner, the flanges 22, 24 will return to their normal position after the lip 12 is fully engaged, moving the hook edge 52 under the lip 12 of the can 14. For this reason, it is preferred that the holder 10 be molded of a slightly bendable or resilient thermoplastic material. The described and illustrate embodiment of the paint brush holder of the present invention is particularly suited to be molded of a single piece of thermoplastic material. Such material is ideal to provide the resiliency and spring-action of both the snap-lock attachment and handle-gripping leaf spring tines.

According to another aspect of the invention, a leg member 58 may also extend downwardly from the bed 16 at a position to engage the outer rim 56 of the can 14. As shown in FIGS. 7 and 8, it is not necessary that this leg member 58 extend across the entire width of the holder 10. It is only necessary that the leg member 58 is of sufficient width to provide the desired angular engagement between the holder 10 and can 14. In order to cause any paint dripped upon the upper surface of the bed 16 to be returned to the can 14 and to prevent migration of paint held on the bristles 60 of the brush 18 toward its handle, it is desirable that the holder 10 be slightly inclined toward its outer end 34. This angle may be only a few degrees and may be maintained by the leg member 58.

If desired, the leg member 58 may be provided with a hook edge 62 which will engage under the rim 56 of the can 14. This engagement will prevent inward tipping of the holder 10, providing further assurance against dislocation of the holder 10 as the paint brush 18 is lifted therefrom. The particular embodiment illustrated in FIGS. 8 and 9 show the flanges 22, 24 and leg member 58 to each be of a preselected length so as to optimally engage the holder 10 onto a typical can 14.

Normally, most interior painting is done with a brush no larger than three inches in width. It is preferred that the holder 10 be constructed to accommodate such brushes by maintaining at least a three-inch clearance between sidewalls 28, 30. A holder 10 so constructed would, of course, accommodate smaller brushes. Because this would be the most commonly desired size, it would be considered wasteful to produce this holder 10 in an unnecessarily wide size. Often, exterior painting is done with a brush of four inches or more in width. An enlarged holder 10 according to this invention may be provided for accommodating oversized or specialty brushes.

It is considered an important aspect of this invention that it may be molded of a single piece of inexpensive thermoplastic material. This allows the holder 10 to be produced and sold at a low cost to the consumer. Because household painting projects are often performed only every few years, and because household painting equipment may be especially prone to being misplaced, it is desirable that a can-mounted paint brush holder such as the present invention be extremely inexpensive, even to the point of being considered disposable. A hole 64 may be provided in the bed 16 at the neck region 32 near the outer end 34 for convenient point-of-purchase display or storage.

It is to be understood that many variations may be made in the illustrated and above-described embodiment without departing from the spirit and scope of my invention. For this reason, my patent protection is not to be limited by these preferred embodiments, but rather only by the below-appended claim or claims interpreted according to accepted doctrines of claim interpretation, including the doctrine of equivalents.

What is claimed is:

1. A paint brush holder attachable to a container having an opening with an annular lip, comprising:

a brush-supporting bed having an inner end and an outer end;

first and second side portions connected to said bed and extending upwardly form the bed;

a brush handle-gripping spring clamp adjacent said outer end including first and second leaf spring tines for longitudinally engaging a paint brush handle wherein each one of said tines is a longitudinal extension of a separate one of said side portions, said tines extending longitudinally from said side portions, free of connection to said bed, wherein said tines are flexibly moved apart by placement of said paint brush handle therebetween and are biased by spring energy against said handle to prevent movement of said paint brush toward said inner end; and a snap-lock attachment adjacent said inner end including first and second downwardly extending arcuate flanges defining an arcuate groove therebetween for engaging said annular lip.

2. A paint brush holder according to claim 1, wherein said first flange includes a hook portion positioned to extend below said lip, said flanges being flexed apart as said lip is being inserted into said arcuate groove and said flanges returning to normal position when said lip is fully engaged within said groove.

3. A paint brush holder according to claim 2, wherein said hook portion extends along substantially the entire length of said first flange.

4. A paint brush holder according to claim 2, wherein said holder is integrally made of a single piece of thermoplastic material.

5. A paint brush holder according to claim 2, wherein said second flange is positioned to extend downwardly into a lid-receiving groove adjacent said annular lip.

6. A paint brush holder according to claim 5, further including a leg member downwardly extending from said bed and positioned to engage an outer edge of said container.

7. A paint brush holder according to claim 1, further including a leg member downwardly extending from said bed and positioned to engage an outer edge of said container.

8. A paint brush holder according to claim 1, wherein said side portions are sidewall upwardly extending from said bed.

9. A paint brush holder according to claim 1, wherein said holder is integrally made of a single piece of thermoplastic material.

* * * * *